US005944577A

United States Patent [19]

Yanofsky et al.

[11] Patent Number: 5,944,577

[45] Date of Patent: Aug. 31, 1999

[54] PLUSH TOY WITH CONCEALED MESSAGE

[75] Inventors: Richard Yanofsky, Quebec, Canada; Peter Yanofsky, Kowloon, The Hong Kong Special Administrative Region of the People's Republic of China

[73] Assignee: Wow Wee International, Kowloon, The Hong Kong Special Administrative Region of the People's Republic of China

[21] Appl. No.: 08/993,740

[22] Filed: Dec. 19, 1997

[51] Int. Cl.[6] ..... A63H 3/02; B42D 3/18

[52] U.S. Cl. ..... 446/371; 281/29; 281/51; 446/369; 446/73

[58] Field of Search ..... 446/369, 73, 385, 446/371, 147, 71, 72, 302; 281/29, 51; 40/538

[56] References Cited

U.S. PATENT DOCUMENTS

| | | | |
|---|---|---|---|
| 1,710,679 | 4/1929 | Pels | 446/73 |
| 4,103,455 | 8/1978 | Silvey | 446/73 |
| 4,508,512 | 4/1985 | Girsch et al. | 446/73 |
| 4,645,470 | 2/1987 | Benton | 446/73 |
| 4,874,340 | 10/1989 | Smallwood | 446/369 |
| 4,909,542 | 3/1990 | Marks | 446/73 |
| 5,059,149 | 10/1991 | Stone | 446/73 |

*Primary Examiner*—Robert A. Hafer
*Assistant Examiner*—Michael B. Priddy
*Attorney, Agent, or Firm*—McAulay Nissen Goldberg Kiel & Hand, LLP

[57] ABSTRACT

Plush toy that includes a concealed message therein is comprised of first and second halves or portions. The first half of the plush toy has a plush-like surface and a flat, printable surface on which a message is written, and the second half has a plush-like surface and a flat surface that optionally has a message written thereon. When the flat surfaces of the first and second halves are brought face to face with one another, magnets within the two halves, or other suitable device, keep the two halves coupled together producing a complete plush toy that only reveals the plush-like surfaces. When the flat surfaces are moved away from one another, the flat surfaces are revealed thus revealing the concealed message(s) written on one or both of the flat surfaces. The plush toy may include one or more straps, or other suitable device, that keep the two halves together even when the flat surfaces thereof are not in face to face contact with one another.

15 Claims, 7 Drawing Sheets

PLUSH TOY WITH CONCEALED MESSAGE

BACKGROUND OF THE INVENTION

The present invention relates to a plush toy having a concealed message therein and, more particularly, to a plush toy which opens up to reveal a hidden message.

DISCUSSION OF THE RELATED ART

As is well known, young children like plush toys, e.g., stuffed animals, and other plush-like toys. There are different forms of plush toys of various shapes and sizes, but traditionally, such toys function only as play-things. Currently, various plush toys and the like are provided with some sort of "intelligence" wherein these toys are able to perform various functions, e.g., talking, eating, etc. However, there still are many practical uses for plush toys that have not yet been realized.

OBJECTS OF THE INVENTION

Therefore, it is an object of the present invention to provide a plush toy which has the novel feature of providing a concealed message therein.

Another object of the present invention is to provide a plush toy which allows for a simple, yet effective and interesting means to communicate a message to the recipient of the plush toy.

A further object of the present invention is to provide a plush toy that is enjoyable and that offers a message from the sender that is uniquely concealed within the plush toy.

Various other objects, advantages and features of the present invention will become readily apparent to those of ordinary skill in the art, and the novel features will be particularly pointed out in the appended claims.

SUMMARY OF THE INVENTION

In accordance with an embodiment of the present invention, a plush toy apparatus is comprised of a first portion (e.g., a first half of an animal-like figure) that has a plush-like surface and a flat, printable surface that has a message thereon, and a second portion (e.g., a second half of the animal-like figure) that has a plush-like surface and a flat surface. The plush toy further includes means for holding the flat surfaces of the first and second portions together such that when the two portions are held together, the plush toy is in a closed position forming a complete toy that reveals only the plush-like surfaces. The message on the interior flat surface is revealed only when the two surfaces being held together are urged apart.

As an aspect of the present invention, magnets disposed within the interiors of the first and second portions are used to hold the two portions (i.e., halves) of the toy together.

As another aspect of the present invention, the plush toy further includes a hinge-like device (e.g., a strap) for attaching the ends of the flat surfaces together so that the two portions remain connected even after the flat surfaces are moved apart.

As a further aspect of the present invention, the flat surface of the second portion includes a message thereon.

As an additional aspect of the present invention, the flat surfaces of either portion has a writeable surface on which a message may be written.

As yet a further aspect of the present invention, a recessed storage compartment is included within one of the flat surfaces.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

The plush toy of the present invention includes a concealed message therein, as will be discussed. The plush toy may be in the form of a stuffed animal, or have another form, such as a stuffed doll-like figure, inanimate object, and so on. Thus, the present invention is not limited to typical plush toys, such as stuffed animals.

Figure 1:
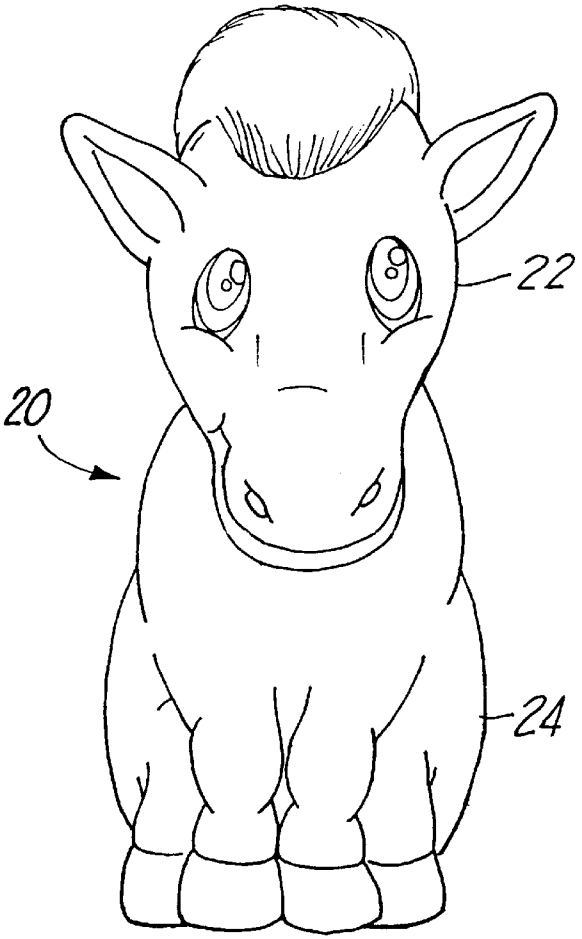
FIG. 1 is a front view of the plush toy with concealed message in accordance with the present invention.
Figure 2:
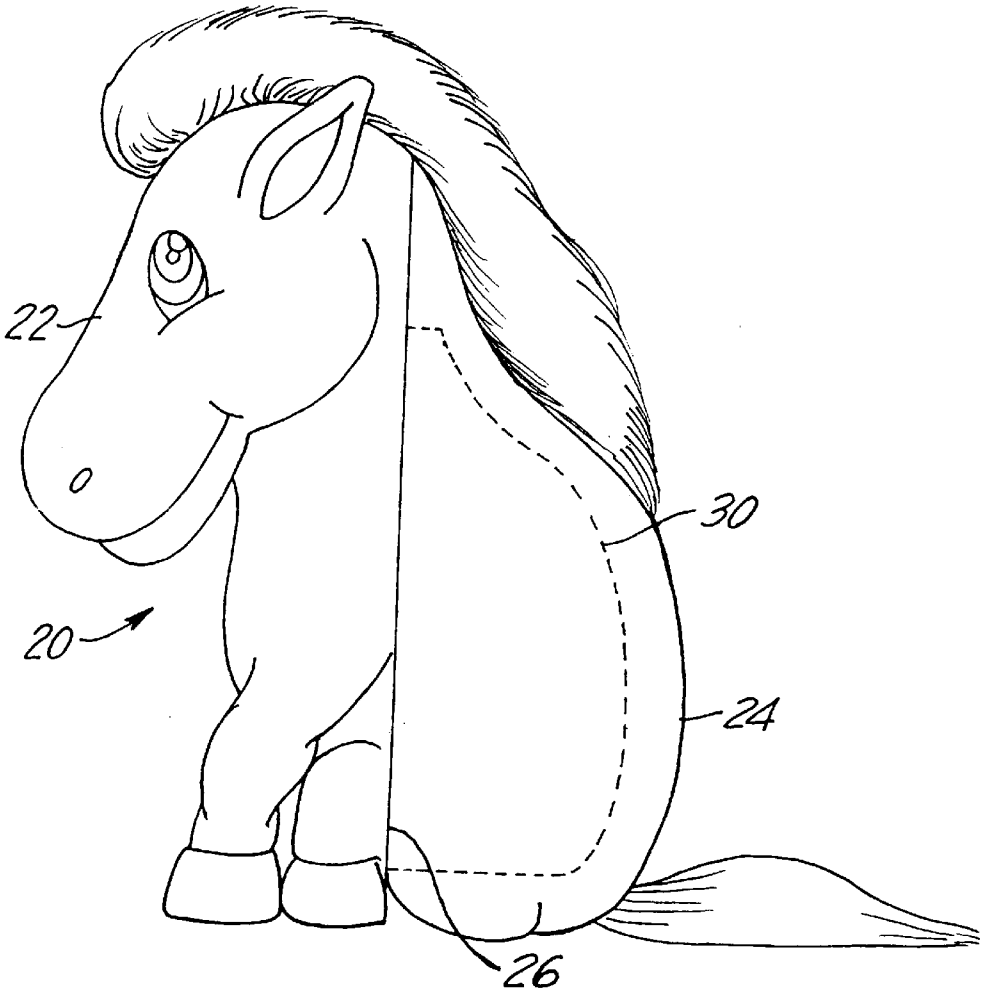
FIG. 2 is a side view, partially in phantom, of the plush toy of the present invention.

Referring now to the drawings, FIG. 1 is a schematic illustration of a plush toy 20 in the form of a horse or pony (hereinafter, "pony 20"). Pony 20 is comprised of a front half or portion 22 and a rear half or portion 24. Front half 22, in the illustrative example, generally includes the head and front feet of the stuffed animal, and rear half 24 generally includes the rear end and rear two feet of the stuffed animal. Referring next to FIG. 2, a side view of Pony 20 illustrates that the pony is divided into its front and rear halves by a straight partition 26. As will be seen, front and rear halves 22, 24 detach from one another revealing flat surfaces on the interiors thereof. Each flat surface includes thereon a respective print or writing surface on which a message may be provided. FIG. 2 shows in phantom a portion of print surface 30 on the interior surface of rear half 24.

Figure 3:
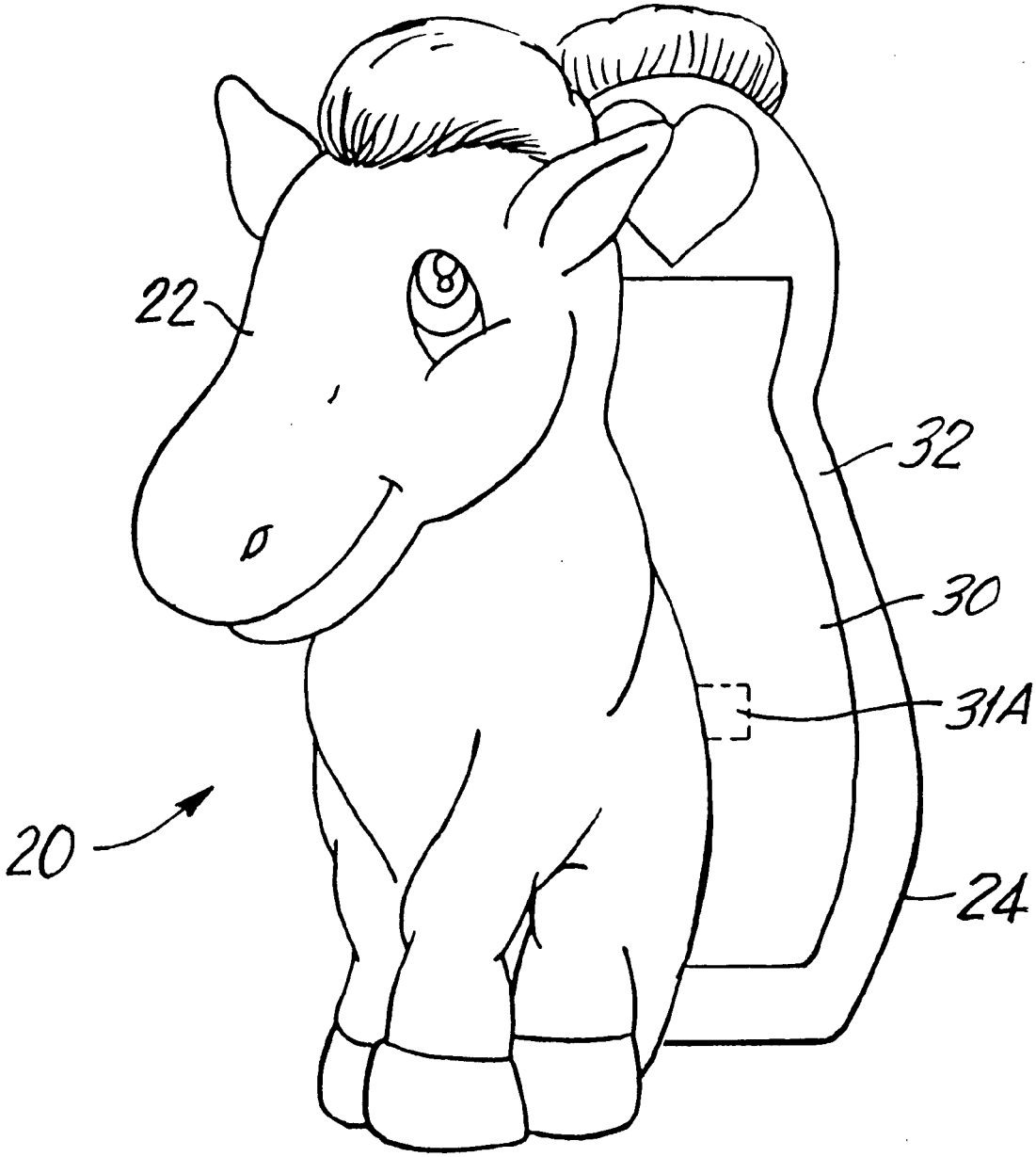
FIG. 3 is a perspective view of the plush toy in a partially opened position.
Figure 4:
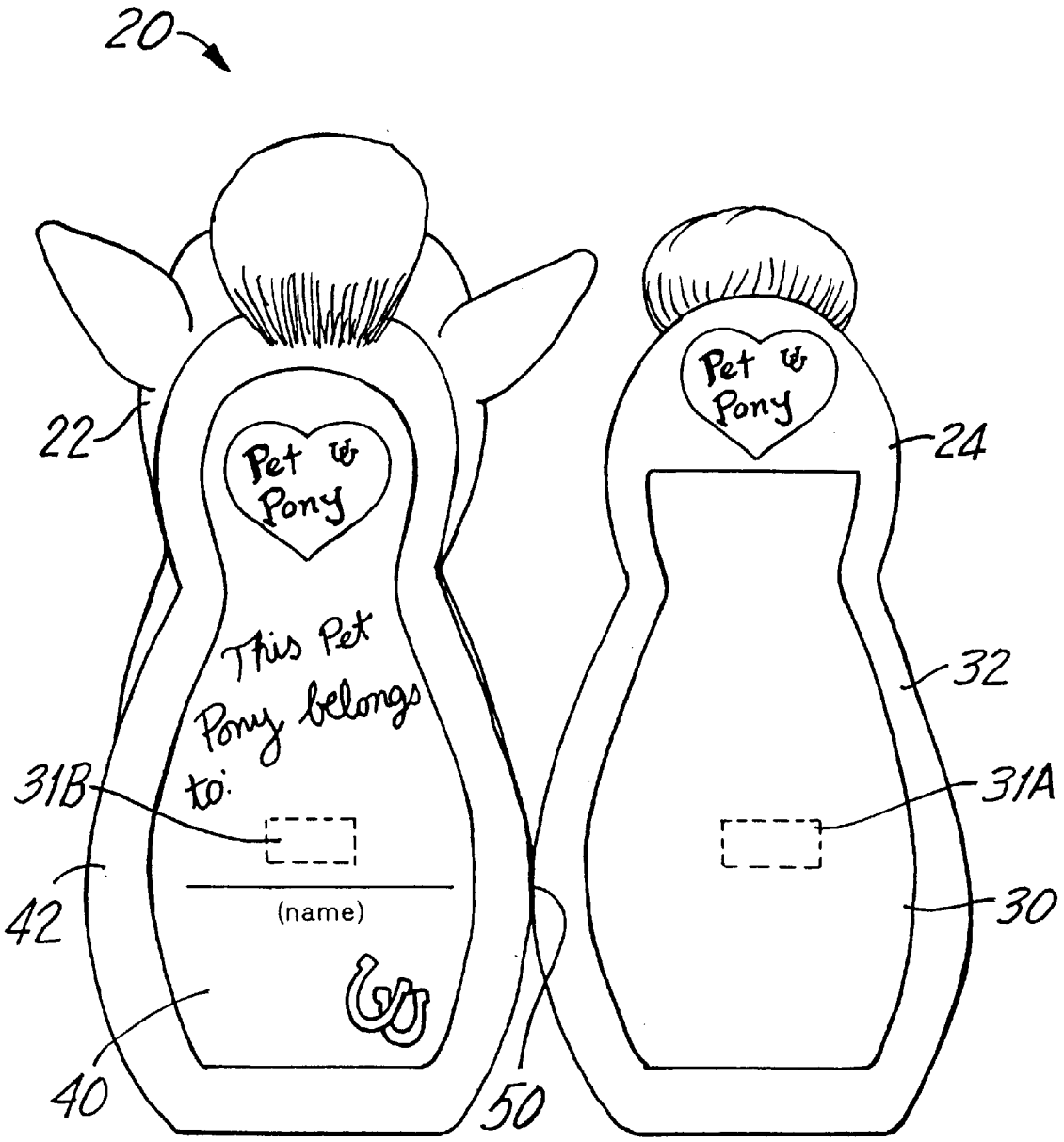
FIG. 4 is a front view of the plush toy in the fully opened position.

As seen more clearly in FIG. 3, front and rear halves 22, 24 detach along a hinge (not shown in FIG. 3) revealing print surface 30 on the interior flat side of rear half 24. A print surface 40 on the flat interior side of front half 22 also is revealed (not shown in FIG. 3). Referring next to FIG. 4, pony 20 is said to be in its open position when both print surfaces 30, 40 are fully revealed (i.e., not concealed by the two halves of pony 20). Both surfaces 30, 40 are relatively flat and are held adjacent to one another by a hinge 50. Thus, these surface are fully concealed (i.e., hidden) when the plush toy of the present invention is in its closed position as shown in FIGS. 1 and 2. In the fully opened position, as shown in FIG. 4, the print surfaces 30, 40 reveal a custom (or pre-printed) message to the recipient of Pony 20. For example, print surfaces 30, 40 may include words and/or graphics (e.g., a picture) thereon. In a preferred embodiment of the present invention, at least one of the surfaces is a writeable-type of surface on which words and/or drawings can be written. Thus, a personalized message may be provided.

The interior surfaces of the two halves 22, 24 also include non-print borders 42 and 32, respectively, such non-print borders being made of the same or similar plush-like material as the exterior surfaces of front and rear halves 22, 24. Alternatively, borders 42, 32 may be made of an appropriate material that is relatively smooth so that the interior surfaces remain concealed when pony 20 is in the closed position. In another alternative embodiment, the interior surfaces of front and rear halves 22, 24 do not include borders, such as shown in the embodiment of FIG. 5, to be discussed.

In accordance with the present invention, pony 20 includes within its body two magnets 31A and 31B that are attracted to one another. One magnet 31B is disposed within front half 22 preferably behind and adjacent to flat surface 40, and the other magnet 31A is disposed within rear half 24, and similarly, preferably behind and adjacent to flat surface 30. Then, when pony 20 is placed in its closed position, the two magnets attract one another tending to keep the two halves 22, 24 of pony 20 coupled together. Although the magnets preferably are not of sufficient strength to prevent the intended detachment of the two halves 22, 24, some force is required for detachment so as to ensure that the message on one or both print surfaces 30, 40 remains concealed during ordinary handling of pony 20. The strength of the magnets is a matter of design choice. In an alternative embodiment of the present invention, front and rear halves 22, 24 are held together, not by magnets, but by another suitable coupling device. Such coupling device may be snaps, velcro material, push-buttons that disconnect when the two halves are compressed together, and so on.

Pony 20 also includes hinge 50 to permanently connect front and rear halves 22, 24. In a preferred embodiment of the present invention, hinge 50 is a short piece of flat material sewn or otherwise adhered to both front and rear halves 22, 24. As pony 20 is opened or closed, the front and rear halves 22, 24 rotate about hinge 50 causing pony 20 to open in a book-like manner. In an alternative embodiment, hinge 50 is a metal or plastic hinge. Of course, other types of hinge-like connectors may be used.

Figure 5:
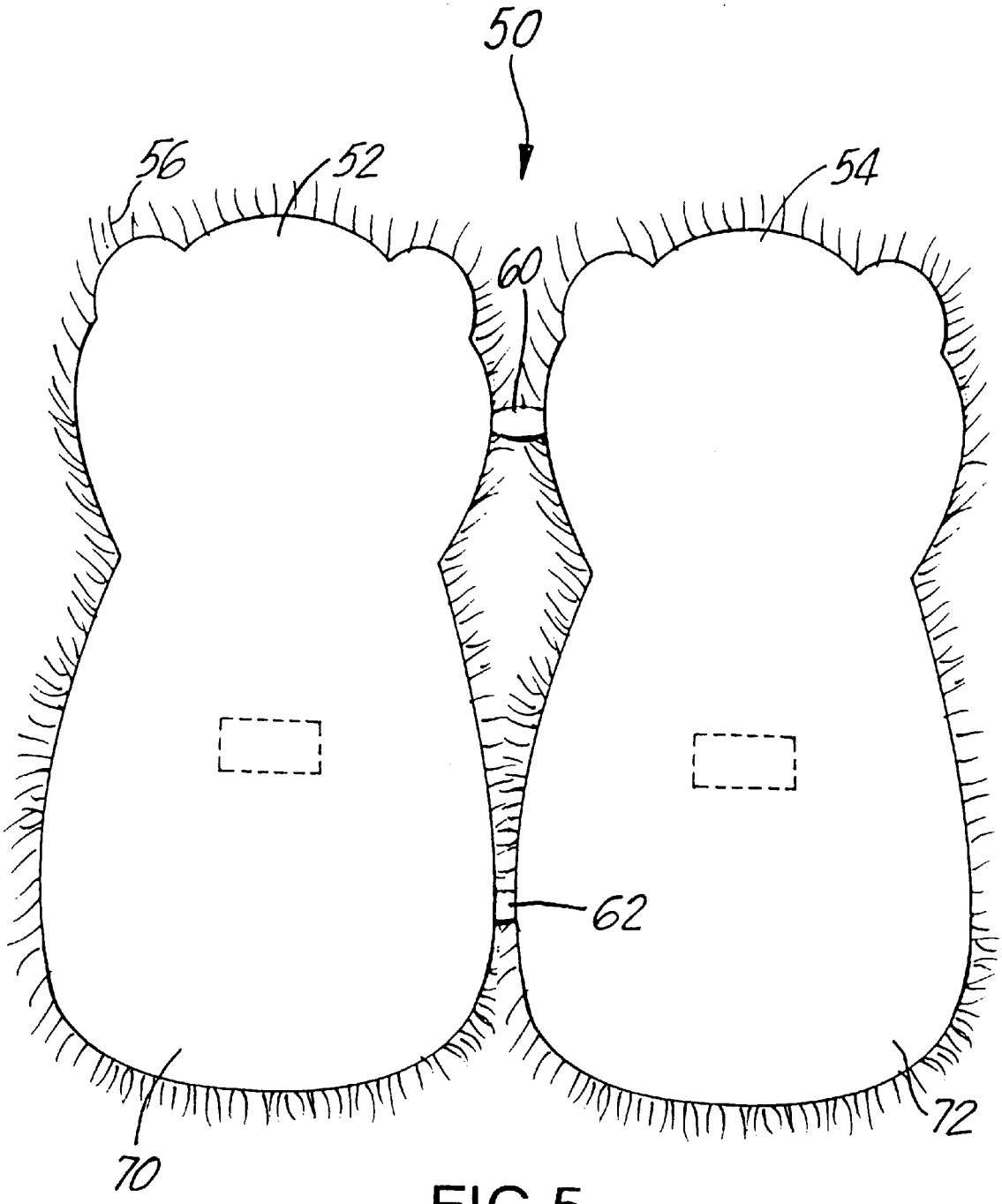
FIG. 5 is a front view of a plush toy in accordance with another embodiment of the present invention.
Figure 7:
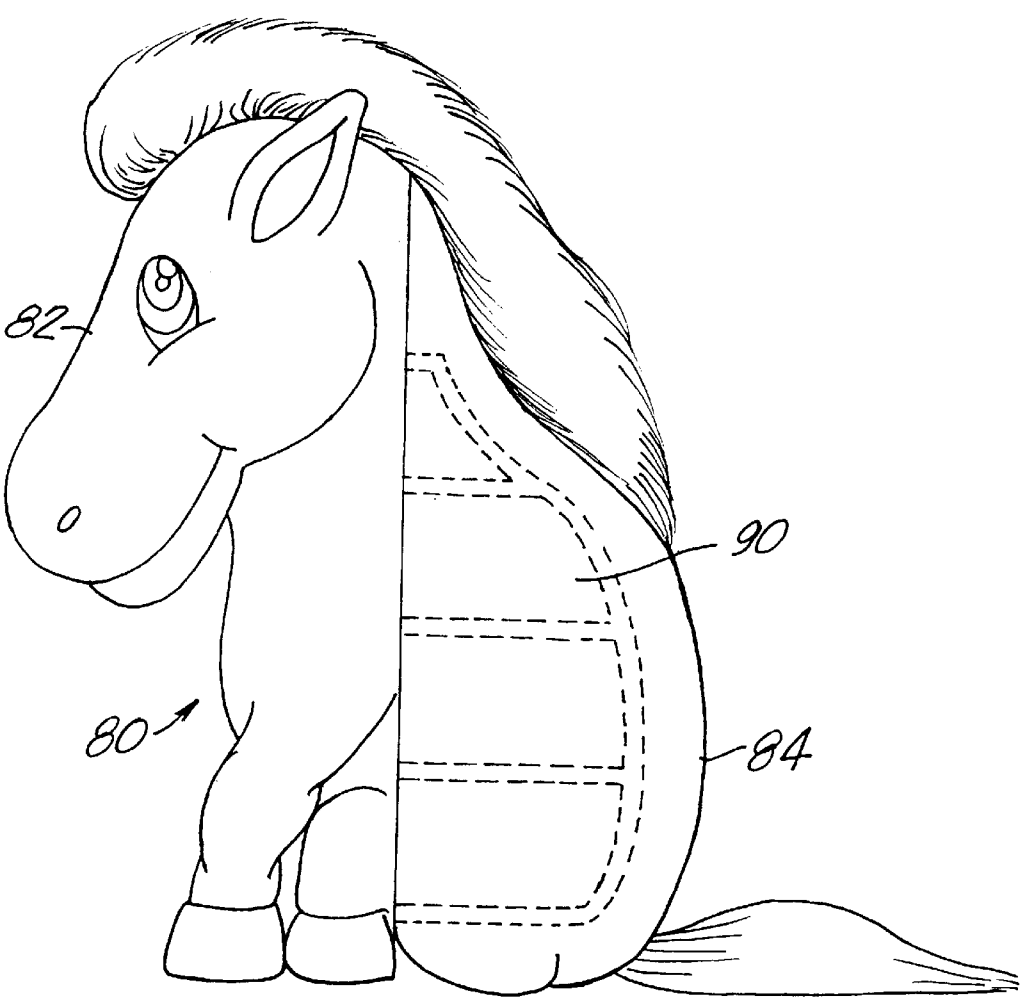
FIG. 7 is a side view, partially in phantom, of the plush toy shown in FIG. 6.

FIG. 5 is a schematic illustration of another plush toy embodying the present invention. As shown, plush toy 50 is in its fully opened position and includes front and rear halves 52, 54. Like the previously discussed embodiment, front and rear halves 52, 54 each has a respective plush-like surface 56, and a respective flat surface 52, 54. However, the plush toy shown in FIG. 5 includes two hinges 60 and 62. Two hinges, as opposed to one hinge, prevents twisting of the two halves thus ensuring that print surfaces 70, 72 on the interior of front and rear halves 52, 54 respectively, are aligned in the manner shown in FIG. 5.

Figure 6:
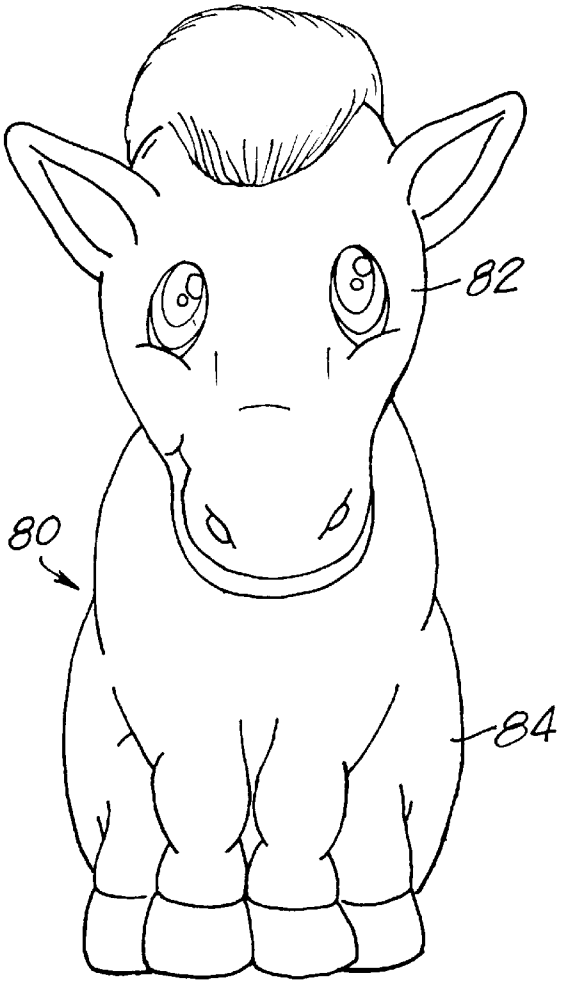
FIG. 6 is a front view of a plush toy in accordance with a further embodiment of the present invention.
Figure 8:
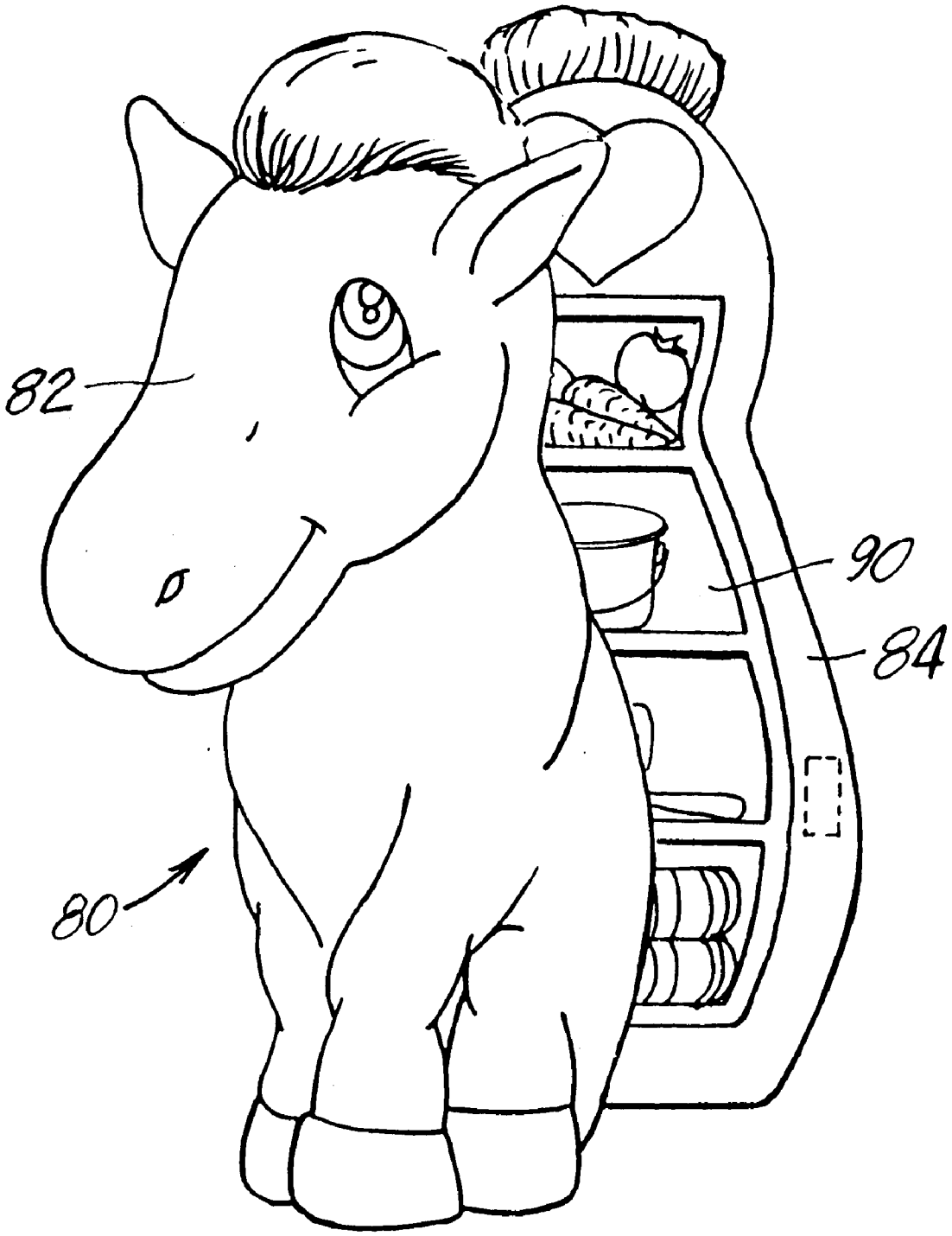
FIG. 8 is a perspective view of the plush toy of FIG. 6 in the partially opened position.
Figure 9:
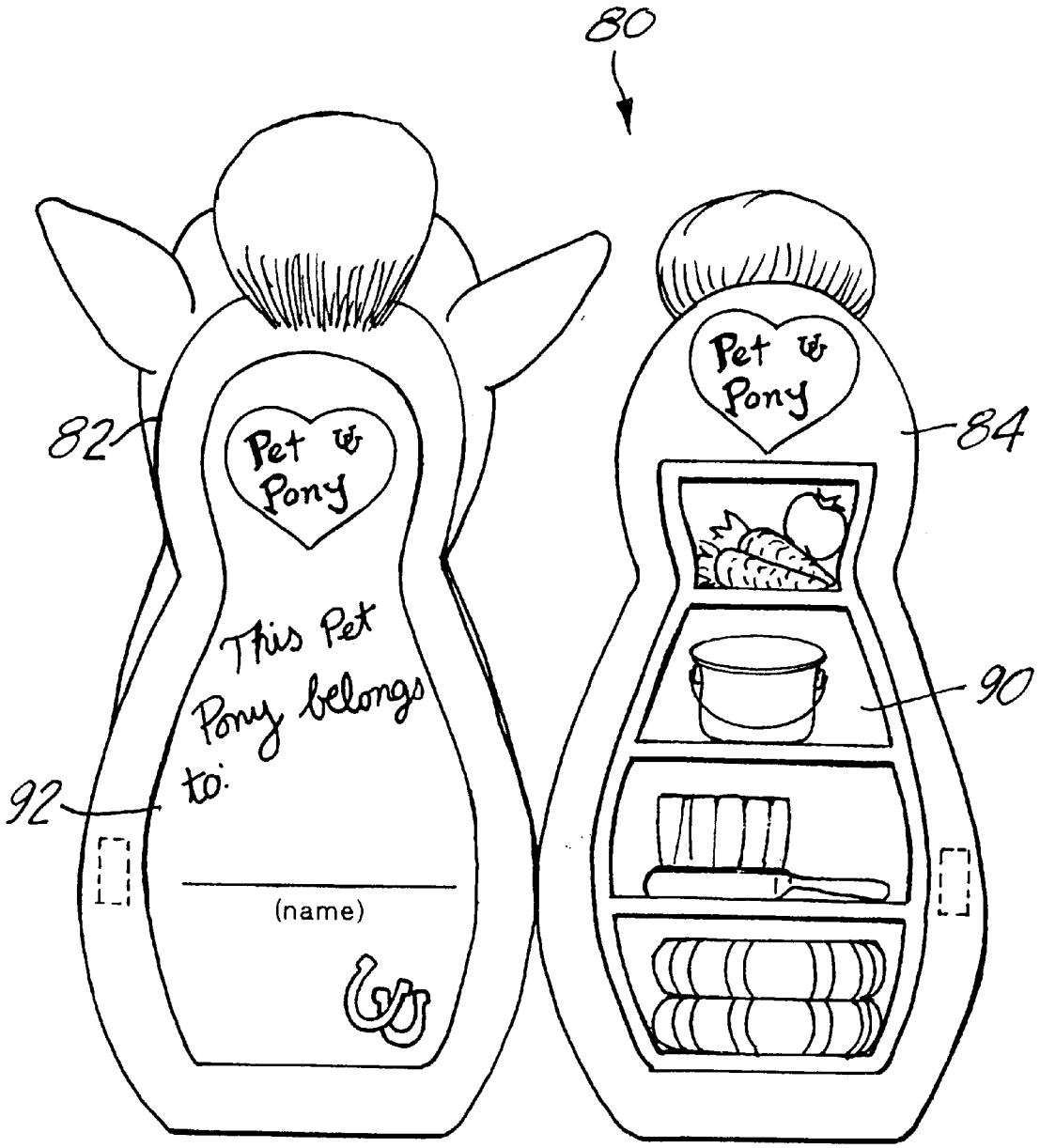
FIG. 9 is a front view of the plush toy of FIG. 6 in the fully opened position.

FIGS. 6–9 illustrate a further embodiment in which the plush toy includes concealed items as well as a concealed message. Referring to FIG. 6, it is seen that pony 80 appears to be identical to pony 20 previously discussed. However, in this embodiment, rear half 84 includes therein a concealed compartment 90 for storing selected items, as shown in phantom in FIG. 7. When pony 80 is opened in the manner previously discussed, the concealed compartment 90, as well as the concealed message, are revealed. FIG. 8 schematically illustrates a partially opened pony 80, partially revealing storage compartment 90 which, as shown, may include stored therein particular items, such as plastic fruit, a brush, etc. FIG. 9 shows pony 80 in the fully opened position which fully reveals storage compartment 90 recessed within the interior of rear half 84, and a print surface 92 on the interior of front half 82. Print surface 92 is similar to print surface 40 previously discussed, therefore further description thereof is omitted herein. As to storage compartment 90, this compartment may contain a multiple number of sub-compartments for storing different types of items. Of course, the particular shape, size and configuration of storage compartment 90 may be different from that described herein.

While the present invention has been particularly shown and described in conjunction with preferred embodiments thereof, it will be readily appreciated by those of ordinary skill in the art that various changes may be made without departing from the spirit and scope of the invention. For example, although the plush toy of the present invention has been described as including detachable front and rear halves, the present invention may be applied to a plush toy having detachable left and right halves, or detachable top and bottom halves, or any other detachable sections that are appropriate.

Therefore, it is intended that the appended claims be interpreted as including the embodiments described herein, the alternatives mentioned above, and all equivalents thereto.

What is claimed is:

1. Plush toy apparatus, comprising:

a first portion having a plush-like surface and a flat, printable surface having a message thereon;

a second portion having a plush-like surface and a flat surface; and holding means for removably holding the flat surfaces of said first and second portions together, said holding means being comprised of first and second magnets, said first and second magnets being disposed within said first and second portions, respectively, such that said first and second magnets tend to urge said flat surfaces of said first and second portions together when said flat surfaces are placed near one another, said first and second portions, when held together by said holding means, form a complete plush toy and reveal only said plush-like surfaces of said first and second portions, and said message on said flat surface of said first portion being revealed only when said first and second portions are not held together by said holding means, wherein said first and second magnets are disposed behind the flat surfaces of said first and second portions, respectively.

2. The plush toy apparatus of claim 1, further comprising means for attaching ends of said flat surfaces of said first and second portions together.

3. The plush toy apparatus of claim 1, wherein said flat surface of said second portion includes a message thereon.

4. The plush toy apparatus of claim 1, wherein said flat, printable surface of said first portion is a writeable surface on which a message may be written.

5. The plush toy apparatus of claim 1, wherein said flat surface of said second portion is a writeable surface on which a message may be written.

6. The plush toy apparatus of claim 1, wherein said flat surface of said second portion includes therein a recessed storage compartment for storing objects.

7. The plush toy apparatus of claim 1, wherein said first and second portions, when the flat surfaces thereof are held together, represent a complete stuffed animal.

8. Plush toy apparatus, comprising:

a body, said body including first and second halves;

said first half having a plurality of surfaces, one of said plurality of surfaces defining an interior surface that is substantially flat and includes thereon a print surface having a message thereon;

said second half having a plurality of surfaces, one of said plurality of surfaces of said second half defining an interior surface that is substantially flat; and holding means for holding said first and second halves of said body together when the interior surfaces of said first and second halves are brought into face to face contact with one another, said body being in a closed position when said first and second halves are held together by said holding means, and said body being in an open position when said first and second halves are not held together by said holding means, said body not revealing either of said interior surfaces of said first and second halves when said body is in said closed position, said message on said print surface of said interior surface of said first half being revealed only when said body is not in said closed position, wherein said holding means is comprised of first and second magnets that are attracted to one another, said first and second magnets being disposed within the first and second halves, respectively, behind the respective interior surfaces of said first and second halves.

9. The plush toy apparatus of claim 8, further comprising hinge means for hinging said first and second halves together such that at least one of said first and second halves rotate about said hinge means when said body is moved between said open and closed positions.

10. The plush toy apparatus of claim 8, wherein said holding means is comprised of first and second magnets that are attracted to one another, said first and second magnets being disposed within non-revealed portions of said first and second halves, respectively.

11. The plush toy apparatus of claim 8, wherein said print surface is a writeable surface on which a message may be written.

12. The plush toy apparatus of claim 8, wherein said interior surface of said second half includes a print surface having a message thereon.

13. The plush toy apparatus of claim 8, wherein said interior surface of said second portion includes therein a recessed storage compartment for storing objects.

14. The plush toy apparatus of claim 8, wherein said body represents an animal figure and includes appendages; and each of said first and second halves of said body includes at least one of said appendages.

15. The plush toy apparatus of claim 14, wherein said first half of said body represents a front half of said animal figure; and said second half of said body represents a rear half of said animal figure.

* * * * *